US005853166A

United States Patent [19]

Koza

[11] Patent Number: 5,853,166

[45] Date of Patent: Dec. 29, 1998

[54] HANDRAIL ASSEMBLY FOR CHILDREN

[76] Inventor: Kim J. Koza, 2507 Wigwam Rd., Aliquippa, Pa. 15001

[21] Appl. No.: 906,425

[22] Filed: Aug. 5, 1997

[51] Int. Cl.[6] ..... E04F 11/18

[52] U.S. Cl. ..... 256/59; 256/68; 256/1; 52/33; 52/184; 248/230.6; 248/295.11

[58] Field of Search ..... 256/1, 59, 65, 256/67–69; 403/385, 384, 389, 390, 377, 378; 82/184, 33, 77; 248/230.6, 295.4, 220.1

[56] References Cited

U.S. PATENT DOCUMENTS

| | | | |
|---|---|---|---|
| 3,005,242 | 10/1961 | Roberts | 256/59 X |
| 3,018,077 | 1/1962 | Buehler . | |
| 3,304,035 | 2/1967 | Davis | 403/378 X |
| 3,995,832 | 12/1976 | Wiese . | |
| 4,030,255 | 6/1977 | Hartman . | |
| 4,556,201 | 12/1985 | Turner . | |
| 4,948,100 | 8/1990 | Stevens . | |
| 4,997,165 | 3/1991 | Wiese | 256/59 |
| 5,337,528 | 8/1994 | Jaworski et al. . | |
| 5,433,551 | 7/1995 | Gordon | 403/377 |
| 5,437,433 | 8/1995 | Rezek . | |
| 5,551,194 | 9/1996 | Toomey . | |
| 5,657,968 | 8/1997 | Marsden | 256/65 |

FOREIGN PATENT DOCUMENTS

| | | | |
|---|---|---|---|
| 3920260 A1 | 1/1991 | Germany . | |
| 6-212761 A | 8/1994 | Japan . | |
| 72532 | 9/1947 | Norway | 248/230.6 |

*Primary Examiner*—Harry C. Kim
*Attorney, Agent, or Firm*—Richard C. Litman

[57] ABSTRACT

A handrail assembly which may be mounted on an existing handrail and used to aid children in ascending or descending a set of stairs. The handrail assembly includes a plurality of clamping devices which may be removably mounted on an existing handrail and which support a secondary handrail at a predetermined position below the existing handrail. The secondary handrail includes a plurality of telescopically mated rods which enable the overall length of the secondary handrail to be adjusted to coincide with the overall length of the existing handrail. Each section of the secondary handrail may be attached at a fixed position along the length of the secondary handrail to a clamping device. Additional clamping devices may be slidably mounted along the length of the secondary handrails to support any long expanses of unsupported sections of the secondary handrail. The clamping devices each have a pair of jaws which may be quickly mounted onto a variety of styles of existing handrails. Each jaw includes a cushioned pad to prevent damage to the existing handrail. The secondary handrails are telescopically attached to the clamping devices which allows the distance from the secondary handrail to the stairs to be adjusted according to the needs of a particular child.

13 Claims, 3 Drawing Sheets

HANDRAIL ASSEMBLY FOR CHILDREN

BACKGROUND OF THE INVENTION

1. Field of the Invention

The present invention relates to a handrail assembly which may be mounted on an existing handrail and used to aid children in ascending or descending a set of stairs.

2. Description of the Related Art

To small children, ascending and descending a flight of stairs is a difficult and dangerous task. Most children are taught early in life to use the aid of a handrail when ascending or descending stairs. Unfortunately, most handrails are designed for adult-sized individuals, and therefore are inadequate for small children or other short individuals. The children are forced to reach upward to grasp onto the handrail while looking downward at their feet and the stairs. This awkward movement tends to offset the balance of the child and place him or her in a precarious position.

Consequently, there is a need for a handrail assembly which may be removably mounted on an existing handrail and includes a lower secondary handrail for aiding children in ascending or descending a set of stairs. The present invention fulfills this need by making a handrail assembly removably mounted on an existing handrail, where it may be mounted or dismounted and transported as necessary. Moreover, the present invention does not interfere with the normal operation of the existing handrail for adults; the present invention simply adds a secondary handrail for children.

The handrail assembly also should have the capability of adjusting the distance from the secondary handrail to the stairs. Additionally, the handrail assembly should have the capability of adjusting the overall length of the secondary handrail to match the overall length of the existing handrail. And finally, the handrail assembly should have the capability of easily mounting to a variety of existing handrail styles without causing damage to the existing handrail.

Attempts have been made to design handrails that are capable of accommodating both children and adults, yet they fail to achieve the same degree of simplicity and versatility as the present invention. For example, U.S. Pat. No. 3,018,077, issued on Jan. 23, 1962, to Albert E. Buehler describes a support for handrail posts that allows for vertical adjustment of the posts to accommodate variations in handrail levels. The patent to Buehler does not describe a removably mounted secondary railing capable of adjusting the overall length of the secondary railing to coincide with a variety of lengths of existing railings.

U.S. Pat. No. 3,995,832, issued on Dec. 7, 1976, to Harold Wiese and U.S. Pat. No. 4,030,255, issued on Jun. 21, 1977, to Arlin P. Hartman describe collapsible bleacher railings which includes several support sections having a multiplicity of telescoping handrail sections that will extend and collapse therewith, and therefore eliminate the requirement for removal from the bleacher sections. The patents to Wiese and Hartman do not describe a removably mounted secondary railing capable of adjusting the distance from the secondary handrail to the stairs.

U.S. Pat. No. 4,556,201, issued on Dec. 3, 1985, to Robert M. Turner describes a handrail for children comprising a series of elongate rail members coupled end-to-end and supported by a plurality of hanging devices. The hanging devices include a support bracket attached to the lower portion of the device and a mounting plate for connection to a wall. The handrail described in the patent to Turner requires the removal of the existing handrail bracket in order to mount and dismount the support bracket for the secondary handrail which renders this invention extremely inconvenient to mount and dismount.

U.S. Pat. No. 4,948,100, issued on Aug. 14, 1990, to Larry L. Stevens describes a handrail assembly for children that is rigidly bolted to a flight of stairs. The patent to Stevens does not describe a removably mounted secondary railing capable of adjusting the overall length of the secondary railing to coincide with a variety of lengths of existing railings, and capable of adjusting the distance from the secondary handrail to the stairs.

U.S. Pat. No. 5,337,528, issued on Aug. 16, 1994, to Frank Jaworski et al. describes a child assist rail and support system which is adapted for attachment to an existing handrail. The assist rail consists of a plurality of suspension elements, with each suspension element having a strap and a locking element provided to maintain the assist rail in a stationary position. The patent to Jaworski et al. does not describe a removably mounted secondary railing capable of adjusting the distance from the secondary handrail to the stairs.

U.S. Pat. No. 5,437,433, issued on Aug. 1, 1995, to Ron Rezek describes an adjustable permanent stair rail system including a plurality of height adjustable balusters. The patent to Rezek does not describe a removably mounted secondary railing capable of adjusting the overall length of the secondary railing to coincide with a variety of lengths of existing railings.

U.S. Pat. No. 5,551,194, issued on Sep. 3, 1996, to Francis J. Toomey describes an adjustable handrail wherein a plurality of telescoping support posts each having a row of slots thereon are mounted on a staircase between the existing rail support posts. A secondary rail member is also included which has a plurality of mounting plates with each mounting plate including a plurality of projections that may be received within the slots on the support posts at a desired height from the stairs. The invention described in the patent to Toomey is not only aesthetically unpleasant, but is also bulky and difficult to dismount and transport as desired. The patent to Toomey fails to describe a removably mounted secondary railing capable of telescopic adjustment of the overall length of the secondary railing to coincide with a variety of lengths of existing railings.

German Patent Application Number 3,929,260(A1), published on Jan. 3, 1991, describes telescoping handrail supporting members having clamping nuts for adjusting the overall height of the handrail and locking the handrail at the desired height. The German Patent Application fails to describe a removably mounted secondary railing capable of telescopic adjustment of the overall length of the secondary railing to coincide with a variety of lengths of existing railings.

Japanese Patent Application Number 6-212,761(A), published on Aug. 2, 1994 describes a handrail wall mounted supporting bracket having means for adjusting the overall height of the handrail without adjusting the position of the supporting bracket on the wall. The Japanese Patent Application fails to describe a removably mounted secondary railing capable of telescopic adjustment of the overall length of the secondary railing to coincide with a variety of lengths of existing railings.

None of the above inventions and patents, taken either singularly or in combination, is seen to describe the instant invention as claimed. Thus a handrail assembly for children solving the aforementioned problems is desired.

SUMMARY OF THE INVENTION

The present invention relates to a handrail assembly which may be mounted on an existing handrail and used to aid children in ascending or descending a set of stairs. The handrail assembly includes a plurality of clamping devices which may be removably mounted on an existing handrail and which support a secondary handrail at a predetermined position below the existing handrail.

The secondary handrail includes a plurality of telescopically mated rods which enable the overall length of the secondary handrail to be adjusted to coincide with the overall length of the existing handrail. In the preferred embodiment, each section of the secondary handrail is attached at a fixed position along the length of the secondary handrail to a clamping device. Additional clamping devices may be slidably mounted along the length of the secondary handrails to support any long expanses of unsupported sections of the secondary handrail.

The clamping devices each have a pair of jaws which may be quickly mounted onto a variety of styles of existing handrails. Each jaw includes a cushioned pad to prevent damage to the existing handrail. The secondary handrails are telescopically attached to the clamping devices which allows the distance from the secondary handrail to the stairs to be adjusted according to the needs of a particular child.

Accordingly, it is a principal object of the invention to provide a handrail assembly which may be removably mounted on an existing handrail and used to aid children in ascending or descending a set of stairs.

It is another object of the invention to provide a handrail assembly having the capability of adjusting the distance from the secondary handrail to the stairs.

It is a further object of the invention to provide a handrail assembly having the capability of adjusting the overall length of the secondary handrail to match the overall length of the existing handrail.

Still another object of the invention is to provide a handrail assembly having the capability of easily mounting to a variety of existing handrail styles without causing damage to the existing handrail.

It is an object of the invention to provide improved elements and arrangements thereof in a handrail assembly for children for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
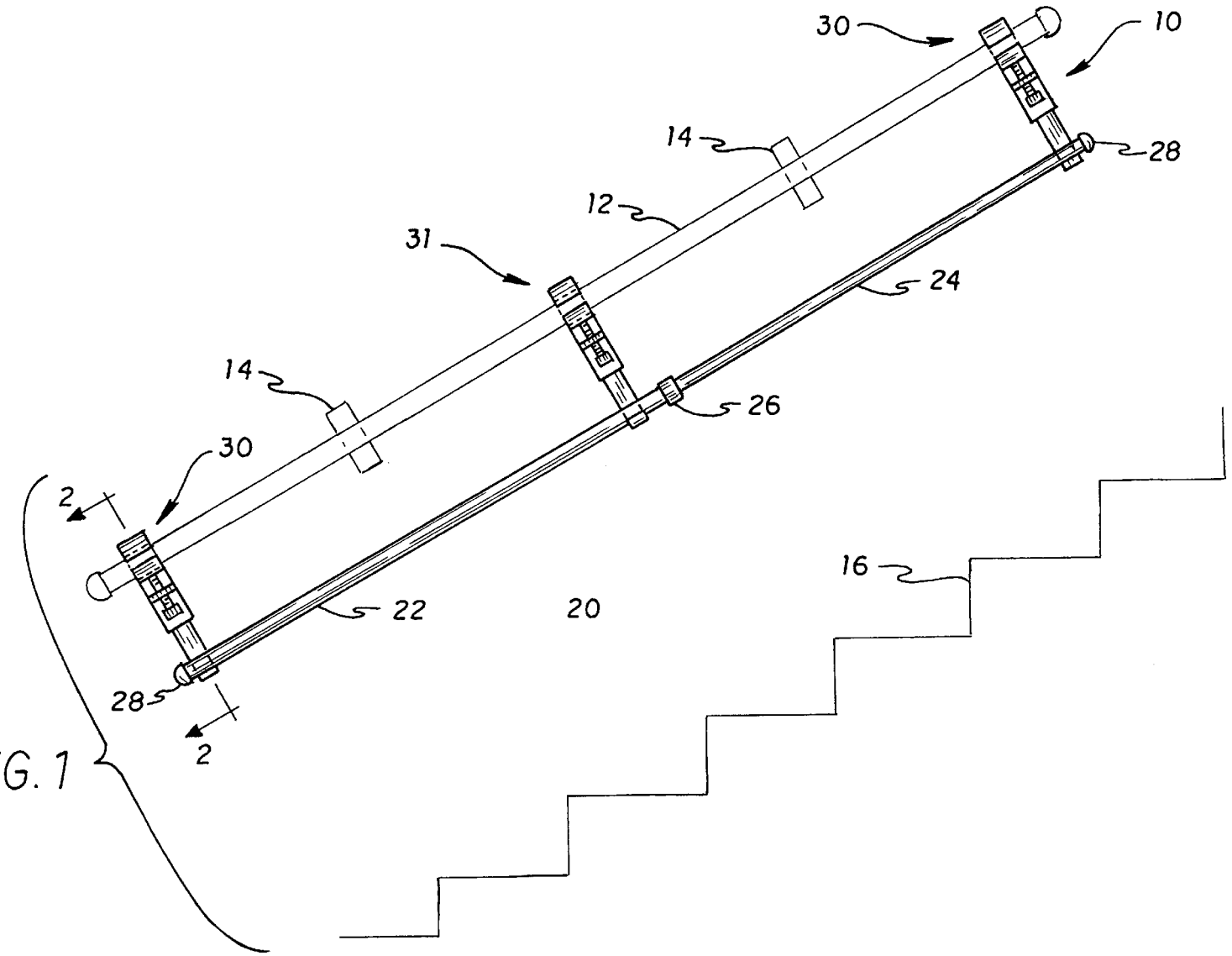
FIG. 1 is an environmental, elevational view of a handrail assembly for children according to the present invention attached to a wall mounted handrail.
Figure 4:
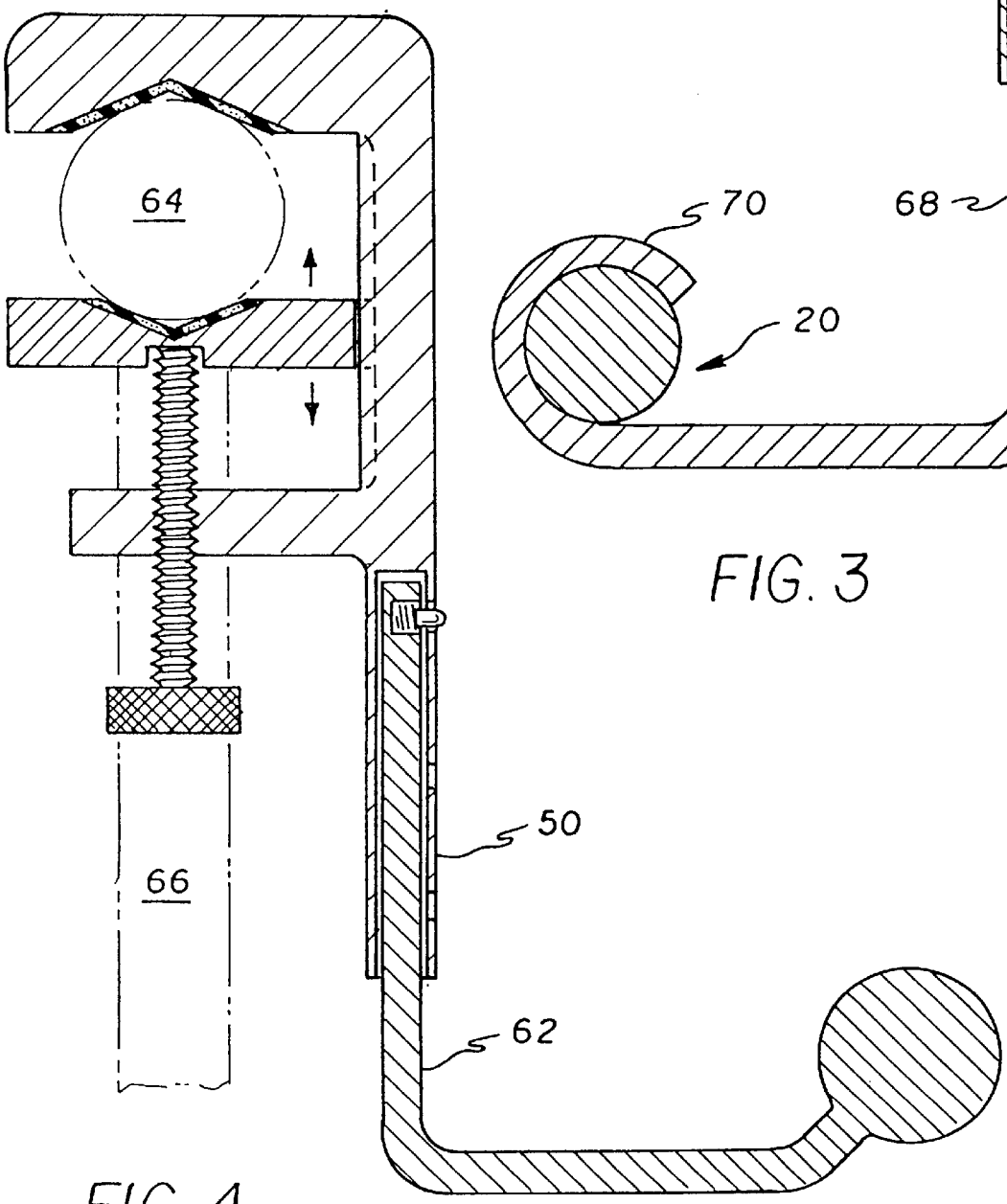
FIG. 4 is an enlarged, cross-sectional view of a clamping device attached to a banister.

Referring to FIG. 1, the handrail assembly of the present invention includes a plurality of clamping devices 30 which may be removably mounted on an existing handrail 12 mounted to the wall using brackets 14, and which support a secondary handrail 20 at a predetermined position below the existing handrail 12. Alternatively, the preferred embodiment of the present invention may be mounted on an existing banister 64 supported by balusters 66, as shown in FIG. 4.

Referring now to FIG. 1, the secondary handrail 20 includes a plurality of telescopically mated rods, 22 and 24, which enable the overall length of the secondary handrail 20 to be adjusted to coincide with the overall length of the existing handrail 12. In the embodiment shown in FIG. 1, rod 22 is a hollow cylindrical rod having an interior surface which slidably receives rod 24. Rod 22 and rod 24 may be designed so that frictional forces between the rods prevents them from freely sliding in relation to one another, similar to adjustable curtain rods. Alternatively the rods may be fitted with a locking collar 26 conventionally used to lock telescoping members. The rods, 22 and 24, are fitted with removable end caps 28 which serve both a safety and an aesthetic purpose.

If a longer handrail assembly 10 is needed to fit a particularly long set of stairs the rods, 22 and 24, are designed so that the end caps 28 can be removed and additional rods (not shown) can be added to the free end of the rods. Each of the additional rods would also be telescopingly related to rods 22 and 24.

Alternative embodiments may include curved rods (not shown) which are used to created a secondary handrail for a circular staircase. Also various shaped joints or elbows may be manufactured to join the ends of the rods used to create a handrail assembly for stairs having a brief landing area in between two flights of stairs, or for staircases having a jog in the wall.

Figure 2:
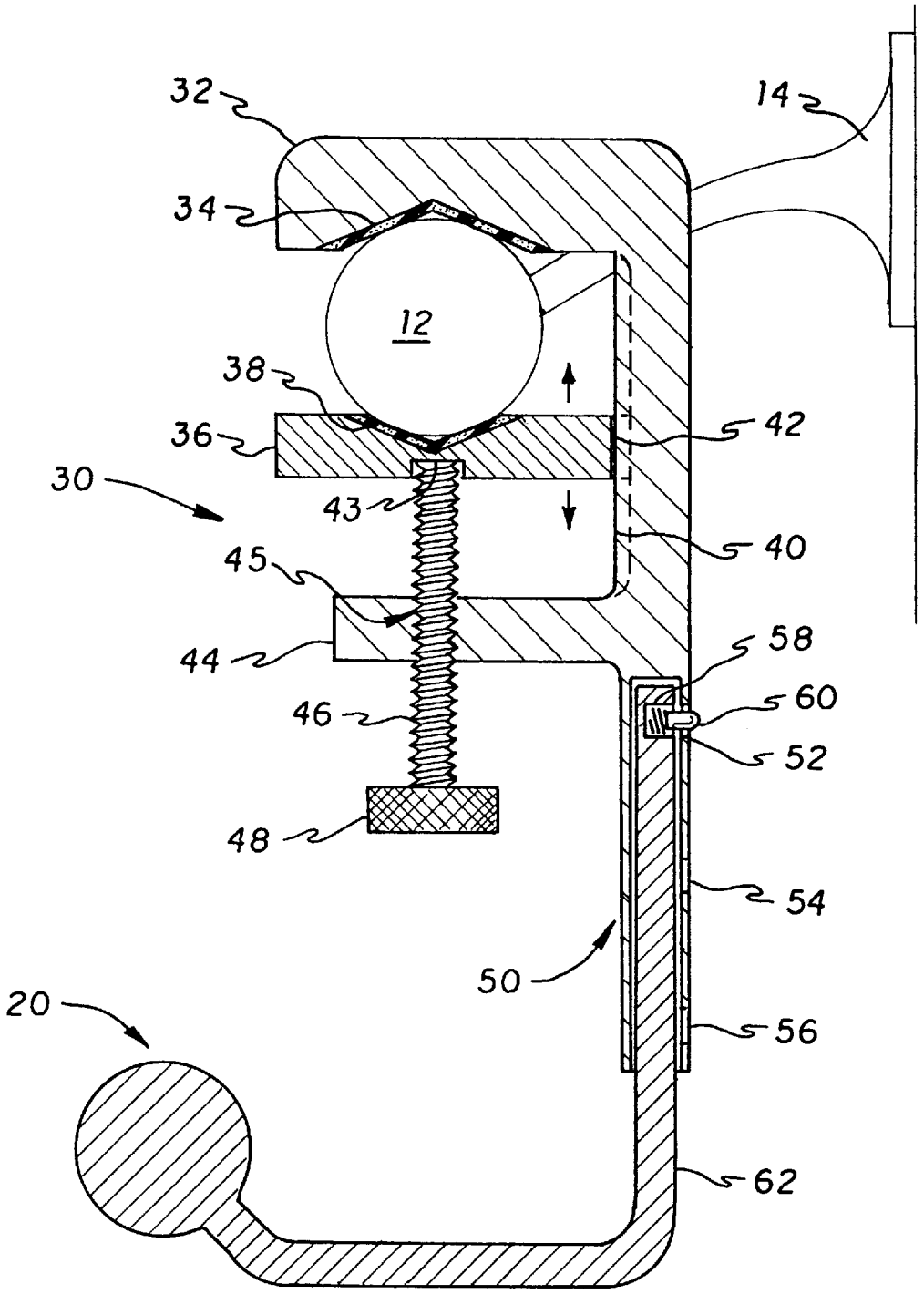
FIG. 2 is an enlarged, cross-sectional view of a clamping device attached to a wall mounted handrail and having a telescoping arm fixed to a secondary handrail.

In the preferred embodiment, each section or rod, 22 and 24, of the secondary handrail 20 is attached to a clamping device 30 at a fixed position along the length of the secondary handrail 20. FIG. 2 shows a clamping device 30 having a telescoping arm 62 fixedly attached to the secondary handrail 20. Additional clamping devices 31 may be slidably mounted along the length of the secondary handrails 20 to support any long expanses of unsupported sections of the secondary handrail 20. By allowing the clamping device 31 to freely slide along the length of the secondary handrail 20, the clamping device 31 may be positioned on the existing handrail 12 so that all of the clamping devices, 30 and 31, are evenly distributed along the length of the secondary handrail 20.

Figure 3:
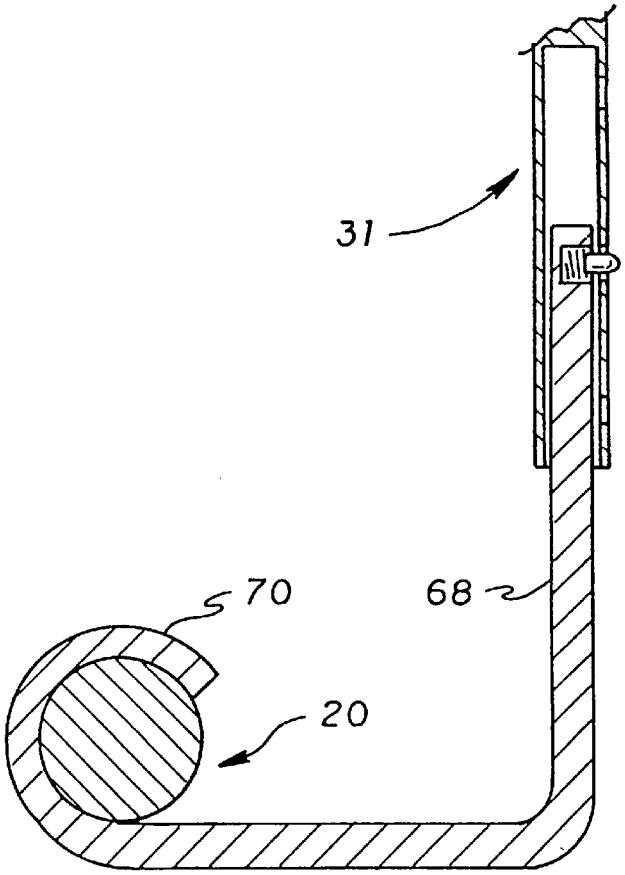
FIG. 3 is a partial, enlarged, cross-sectional view of a telescoping arm of a clamping device with the telescoping arm being slidably mounted along the length of a secondary handrail.

FIG. 3 shows one manner in which the telescoping arm 68 of the clamping device 31 may be slidably mounted to the secondary handrail 20. As shown in FIG. 3, the end 70 of the telescoping arm 68 may be curved around the secondary handrail 20, thereby giving the secondary handrail 20 support yet allowing the clamping device 31 to slide along the length of the secondary handrail 20. An alternative manner of slidably mounting the clamping device 31 to the secondary handrail is by forming a T-shaped slot (not shown) along the length of the secondary handrail 20 along the bottom of rods 22 and 24, and having a mating T-shaped protrusion (not shown) on the end of telescoping arm 68. The T-shaped protrusion is then slidably engaged within the T-shaped slot to allow the clamping device 31 to slide freely along the length of the secondary handrail 20. Any other similar method of supporting the secondary handrail 20 which allows for the clamping device 31 to slide along the length of the secondary handrail 20 may alternatively be used.

The clamping devices 30 and 31 each have a pair of jaws, 32 and 36, which may be quickly mounted onto a variety of styles of existing handrails 12. In the preferred embodiment jaw 32 is stationary while jaw 36 is capable of translation towards jaw 32. Jaw 36 is connected to a threaded screw 46 which is fixed to a knob 48. When knob 48 is rotated the screw 46 is forced through a threaded hole 45 in member 44, which forces the end 43 of the screw 46 to move the jaw 36. Jaw 36 is prevented from rotating by a groove 42 in the jaw 36 which is engaged to an elongated protrusion 40 on the neck of the clamp. The clamping devices described herein are merely for illustrative purposes, any other conventional clamping devices may alternatively be used.

A first alternative embodiment of the clamping devices, 30 and 31, includes a thin strip of flexible plastic or metal (not shown) in the shape of a "C" having a middle portion and two terminal end portions. The middle portion of the C-shaped strip is attached to the hollow sleeve section 50. The terminal end portions each have a hole therethrough and are joined by a threaded screw extending through both holes. The C-shaped strip can be placed around an existing handrail 12 and the screw adjusted to bring the terminal end portions together, thereby clamping down on the existing handrail 12.

A second alternative embodiment of the clamping devices, 30 and 31, includes a first jaw (not shown) similar to jaw 32 which includes a plurality of passages each for receiving a threaded bolt, the passages being either slots or holes positioned to allow passage of the bolts on both sides of a handrail. A second jaw (not shown) also having slots or a plurality of holes therethrough is passed below a handrail and each hole or slot of the second jaw is aligned with the hole or slot of the first jaw. Each of a pair of threaded bolts (not shown) is then placed through the slot or hole in the first jaw and through the slot or hole of the second jaw, and the assembly is held in place by a pair of threaded nuts (not shown), each threaded onto a bolt. Thus, the threaded nuts may be used to translate the second jaw towards the first jaw to clamp down on the existing handrail 12. The slots or plurality of holes on the first and second jaws allows the distance between the bolts to be adjusted to fit a variety of handrails having different sizes and shapes.

Each jaw, 32 and 36, includes a cushioned pad, 34 and 38 respectively, to prevent damage to the existing handrail 12. The shape of the jaws, 32 and 36, as well as the shape of the cushioned pads, 34 and 38, may be manufactured in a variety of contours to match the cross-sectional shape and size of a particular style of existing handrail 12. For example, since many conventional existing handrails 12 have a flat surface (not shown) along the bottom thereof, jaw 36 and cushioned pad 38 may be manufactured with a flat surface for sitting flush with the flat bottom surface of the existing handrail.

The secondary handrails 20 are telescopically attached to the clamping devices, 30 and 31, which allows the distance from the existing handrail 12 to the secondary handrail 20, and therefore the distance from the secondary handrail 20 to the stairs 16, to be adjusted according to the needs of a particular child. This telescoping attachment may be achieved using a variety of mechanisms. FIG. 2 shows one such mechanism where the telescoping arm 62 is slidably received within a hollow sleeve section 50. Note that the hollow sleeve section 50 may extend further into the body of the clamping device, 30 and 31, towards jaw 32 in order to allow for greater adjustment of the secondary handrail 20. The telescoping arm 62 includes a spring 58 biased pin 60 which protrudes through one of a plurality of holes, 52, 54, and 56, along the sleeve section 50. An alternative mechanism (not shown) is a threaded thumb screw engaged to a threaded hole 56. The thumb screw may be tightened against the telescoping arm 62, thereby frictionally engaging the telescoping arm 62 and preventing it from sliding within the sleeve section 50. Other conventional mechanisms may alternatively be used.

An alternative embodiment of the telescoping arm 62 is contemplated by the present invention wherein the telescoping arm 62 is constructed of a plurality of telescoping sections (not shown) interconnected in the same manner as the telescoping arm 62 and hollow sleeve section 50 above. This embodiment would allow the secondary handrail 20 to be adjusted even further towards the stairs 16.

FIG. 4 shows the clamping device 30 attached to a banister 64. In this figure the clamping device 30 and the telescoping attachment mechanism are essentially identical to that described previously, however the telescoping arm 62 extends in the opposite direction from the telescoping arm 62 shown in FIG. 2. The clamping device 30 shown in FIG. 2 could be modified such that holes, 52, 54, and 56, extend through both sides of the sleeve section 50 and the telescoping arm 62 is turned 180 degrees, to achieve a similar functional result to the clamping device shown in FIG. 4. The configuration shown in FIG. 4 allows the handrail assembly 10 to be used without interference from the balusters 66.

The handrail assembly 10 may be quickly disassembled for compact storage and/or transportation by simply detaching the clamping devices, 30 and 31, from the existing handrail 12 and disengaging the rods, 22 and 24. The secondary handrail 20 can be manufactured in a variety of different overall telescopic lengths to accommodate different size staircases. The parts of the handrail assembly 10 can be manufactured using a variety of different rigid materials, such as aluminum, steel, plastic, or wood. The handrail assembly 10 may be colored to compliment the existing home color scheme or the existing handrail 12 or the handrail assembly 10 may be colored for heightened visibility to aid visually impaired individuals.

It is to be understood that the present invention is not limited to the embodiments described above, but encompasses any and all embodiments within the scope of the following claims.

I claim:

1. A handrail assembly comprising:

a telescoping handrail including a hollow first rod having a first end and a second end, and a second rod having a first end and a second end, said first end of said second rod being telescopically received within said second end of said first rod;

means for removably attaching said first end of said first rod to an existing handrail including a clamp member having a first jaw member, a second jaw member movably mounted to said clamp member opposite said first jaw member, and an arm member having a first end attached to said clamp member, said arm member having a second end attached to said first end of said first rod;

means for removably attaching said second end of said second rod to the existing handrail;

means for supporting said second end of said first rod removably attached to the existing handrail; and means for adjusting the distance from said telescoping handrail to the existing handrail.

2. The handrail assembly as defined in claim 1 wherein said means for supporting said second end of said first rod removably attached to the existing handrail comprises a clamp having an arm slidably engaged to said first rod.

3. The handrail assembly as defined in claim 1 wherein:

said first jaw member has a first cushion thereon; and said second jaw member has a second cushion thereon.

4. The handrail assembly as defined in claim 1 wherein said means for adjusting the distance from said telescoping handrail to the existing handrail comprises:

said clamp member having a hollow sleeve section rigidly attached thereto; and said second end of said arm member being slidably received within said hollow sleeve section.

5. The handrail assembly as defined in claim 4 wherein:

said hollow sleeve section has a plurality of apertures; and said second end of said arm member has a spring-biased protrusion thereon, said spring biased protrusion selectively engaging one of said plurality of apertures.

6. The handrail assembly as defined in claim 4 wherein:

said hollow sleeve section has a threaded hole; and said means for adjusting the distance from said telescoping handrail to the existing handrail further includes a threaded thumbscrew threadably engaged to said threaded hole and frictionally engaged to said second end of said arm member.

7. The handrail assembly according to claim 1 wherein said telescoping handrail further comprises means for locking said first rod in position relative to said second rod attached to said second end of said first rod.

8. A handrail assembly comprising:

a telescoping handrail; and a plurality of clamps, each having an arm member having a first end attached to said telescoping handrail, each of said clamps including a clamp member having a first jaw member, a second jaw member movably mounted to said clamp member opposite said first jaw member, and said arm member having a second end slidably engaged to said clamp member.

9. The handrail assembly according to claim 8 wherein said telescoping handrail comprises:

a hollow first rod having a first end; and a second rod having a first end, said first end of said second rod being telescopically received within said first end of said first rod.

10. The handrail assembly as defined in claim 8 wherein:

said first jaw member has a first cushion thereon; and said second jaw member has a second cushion thereon.

11. The handrail assembly as defined in claim 8 wherein:

each of said clamps has a hollow sleeve section rigidly attached thereto; and said second end of said arm member being slidably received within said hollow sleeve section.

12. The handrail assembly as defined in claim 11 wherein:

said hollow sleeve section has a plurality of apertures; and said second end of said arm member has a spring-biased protrusion thereon, said spring biased protrusion selectively engaging one of said plurality of apertures.

13. The handrail assembly as defined in claim 11 wherein:

said hollow sleeve section has a threaded hole; and said handrail assembly further includes a threaded thumbscrew threadably engaged to said threaded hole and frictionally engaged to said second end of said arm member.

* * * * *